US010858167B2

(12) United States Patent
D'Anglade

(10) Patent No.: US 10,858,167 B2
(45) Date of Patent: Dec. 8, 2020

(54) CORNER PIECE FOR PACKAGING

(71) Applicant: ABZAC CANADA INC., Drummondville (CA)

(72) Inventor: Pierre-Michel D'Anglade, Montreal (CA)

(73) Assignee: ABZAC CANADA INC., Drummondville (CA)

( * ) Notice: Subject to any disclaimer, the term of this patent is extended or adjusted under 35 U.S.C. 154(b) by 307 days.

(21) Appl. No.: 15/547,387

(22) PCT Filed: Feb. 19, 2016

(86) PCT No.: PCT/CA2016/050153
§ 371 (c)(1),
(2) Date: Jul. 28, 2017

(87) PCT Pub. No.: WO2016/131142
PCT Pub. Date: Aug. 25, 2016

(65) Prior Publication Data
US 2018/0022525 A1 Jan. 25, 2018

Related U.S. Application Data

(60) Provisional application No. 62/117,973, filed on Feb. 19, 2015.

(51) Int. Cl.
*B65D 81/05* (2006.01)
*B65D 71/00* (2006.01)
(Continued)

(52) U.S. Cl.
CPC ..... *B65D 81/054* (2013.01); *B65B 11/004* (2013.01); *B65B 61/20* (2013.01); *B65D 5/4283* (2013.01); *B65D 71/0096* (2013.01)

(58) Field of Classification Search
CPC ..... B65D 5/5033; B65D 5/4283; B65D 81/053–058; B65D 71/0096;
(Continued)

(56) References Cited

U.S. PATENT DOCUMENTS 825,523 A * 7/1906 Dewey ..... E04B 2/60 229/198.1
2,956,705 A * 10/1960 Clingman ..... A47B 47/0008 217/12 R
(Continued)

FOREIGN PATENT DOCUMENTS

CA 2738558 A1 1/2012
JP 6-115567 A 4/1994
(Continued)

OTHER PUBLICATIONS

Notification of Transmittal of the International Search Report and the Written Opinion of the International Searching Authority, or the Declaration corresponding to International Application No. PCT/CA2016/050153 dated May 18, 2016.
(Continued)

*Primary Examiner* — Dariush Seif
(74) *Attorney, Agent, or Firm* — Myers Bigel, P.A.

(57) ABSTRACT

A corner piece is provided for forming packaging elements. The corner piece includes an inner member and an outer member having respective apexes. A connecting member connects the inner and outer members and substantially aligns their apexes, while spacing the inner and outer members apart from one another. A securing element is provided in the outer member for securing an exterior edge protector along the outer member. The securing element includes substantially U-shaped retaining walls engageable with the exterior edge protector. In some embodiments, the spacing between the inner and outer members defines retain-
(Continued)

ing cavities for securing adjacent sidewalls of a storage container.

19 Claims, 13 Drawing Sheets

(51) Int. Cl.
*B65D 5/42* (2006.01)
*B65B 11/00* (2006.01)
*B65B 61/20* (2006.01)

(58) Field of Classification Search
CPC ..... B65B 11/004; B65B 61/20; E04B 2001/6191; E04B 2001/6195; E04B 2002/726
USPC ..... 53/410; 229/199, 918; 52/204.58, 633; 108/55.1, 57.17, 57.16; 220/646, 647, 220/639; 206/453, 586
See application file for complete search history.

(56) References Cited

U.S. PATENT DOCUMENTS 3,072,313 A 1/1963 Svendsen
3,129,868 A 4/1964 Jenk
3,338,012 A * 8/1967 Kappenhagen ..... A47B 47/03 312/223.1
3,362,739 A * 1/1968 Hans Staeger ..... E04B 1/34384 52/285.1
3,433,354 A * 3/1969 Liebel ..... B65D 85/30 206/586
3,511,464 A 5/1970 Doll
3,672,952 A 6/1972 Brown et al.
3,725,170 A 4/1973 Doll
3,734,389 A 5/1973 Brown
3,879,253 A 4/1975 Doll
3,980,221 A * 9/1976 Okada ..... B65D 5/5033 206/586
3,989,397 A * 11/1976 Baker ..... F16B 12/02 403/205
4,201,138 A * 5/1980 Cox ..... B65D 71/0096 108/55.1
4,210,274 A * 7/1980 Leonard ..... B65D 5/006 229/198.1
4,258,519 A * 3/1981 Hugens ..... E04B 1/6112 52/282.1
4,292,901 A * 10/1981 Cox ..... B65D 71/0096 108/55.1
4,496,054 A * 1/1985 Koltun ..... B65D 81/056 206/453
4,689,930 A * 9/1987 Menchetti ..... E04B 2/7409 52/275
4,712,942 A * 12/1987 Brown ..... F16B 5/00 403/174
4,731,973 A * 3/1988 Stenemann ..... A47F 3/12 52/767
4,771,893 A * 9/1988 Liebel ..... B65D 81/054 206/326
4,916,879 A * 4/1990 Boeshart ..... E04B 2/8652 249/40
5,048,689 A * 9/1991 McFarland ..... B65D 5/5033 206/453
5,181,611 A * 1/1993 Liebel ..... B65D 71/04 206/453
5,267,651 A * 12/1993 Hughes ..... B65D 5/5033 206/453
5,613,335 A * 3/1997 Rennich ..... E04F 13/06 52/254
5,658,483 A * 8/1997 Boeshart ..... E04B 2/8652 249/191
5,722,551 A * 3/1998 Cocciemiglio, Jr. .... B65D 9/24 220/4.33
5,813,537 A * 9/1998 DeReu ..... B65D 81/054 206/453
6,286,683 B1 * 9/2001 Hunt ..... B65D 81/054 206/320
6,324,804 B1 * 12/2001 Hoogstraten ..... E04B 2/8652 249/191
D455,219 S * 4/2002 Ohanesian ..... D25/124
6,460,724 B1 * 10/2002 Bradford ..... B65D 5/0055 220/6
6,519,906 B2 * 2/2003 Yost ..... E04B 2/8635 249/18
6,527,119 B1 3/2003 Markert et al.
6,564,993 B1 * 5/2003 Wassink ..... B65D 5/0055 220/642
6,881,469 B2 4/2005 Hightower
6,915,603 B2 * 7/2005 Hunt ..... B65D 5/4283 108/55.1
6,935,085 B2 * 8/2005 Little, Jr. ..... E04B 2/7854 52/285.1
7,014,046 B2 * 3/2006 Niu ..... B65D 5/5033 206/320
7,216,765 B2 * 5/2007 Marked ..... B65D 81/053 206/320
7,299,924 B2 11/2007 Robinson, Jr.
7,383,952 B2 6/2008 Kruelle et al.
7,686,169 B1 * 3/2010 Harte ..... B65D 81/09 206/583
8,443,975 B2 5/2013 Butch, Jr. et al.
2001/0001446 A1 5/2001 Moreyra
2002/0144923 A1 10/2002 Baechle
2002/0189969 A1 12/2002 Renck
2003/0111383 A1 6/2003 Qiu et al.
2004/0255537 A1 12/2004 Dagleish et al.
2005/0082200 A1 4/2005 Robinson, Jr.
2005/0087663 A1 4/2005 Schroeder
2005/0121356 A1 6/2005 Wisecarver
2005/0121357 A1 6/2005 Robinson, Jr. et al.
2009/0029130 A1 * 1/2009 Stubing ..... B65D 81/053 428/213
2011/0000906 A1 * 1/2011 Wood ..... B65D 5/4283 220/1.5
2012/0000815 A1 1/2012 Butch, Jr. et al.
2014/0050897 A1 2/2014 Rometty et al.
2014/0138271 A1 * 5/2014 Grinwald ..... B65D 81/054 206/386
2017/0267429 A1 * 9/2017 Grinwald ..... B65D 81/054

FOREIGN PATENT DOCUMENTS

JP 5229574 B2 7/2013
TW M297354 U 9/2006
WO 2009/061344 A2 5/2009
WO WO 2012/003054 A1 1/2012
WO WO 2015/140640 A2 9/2015

OTHER PUBLICATIONS

Extended European Search Report corresponding to European Patent Application No. 12792399.3 (7 pages) (dated Jan. 21, 2015).
Notification of Transmittal of the International Search Report and the Written Opinion of the International Searching Authority, or the Declaration corresponding to International Patent Application No. PCT/CA2012/050347 (dated Jun. 26, 2012).

* cited by examiner

CORNER PIECE FOR PACKAGING

RELATED APPLICATIONS

This application is a 35 U.S.C. § 371 national stage application of PCT Application No. PCT/CA2016/050153, filed on Feb. 19, 2016, which claims priority from U.S. Provisional Patent Application No. 62/117,973 filed on Feb. 19, 2015, the contents of which are incorporated herein by reference in their entireties. The above-referenced PCT International Application was published in the English language as International Publication No. WO 2016/131142 A1 on Aug. 25, 2016.

FIELD

The present invention relates to packaging for large articles. More particularly, it relates to a corner piece which can be used to form protective assemblies for packaging an article and protecting exterior edges of the article.

BACKGROUND

Large or heavy articles generally require specialized packaging for storage and transport to avoid damage. A popular means for packaging large articles involves the use of L-shaped cardboard corner posts, also known as edge protectors. These posts can be secured between a lid and a base, and can serve to protect the corners of the article while also providing vertical support when the article is palletized and stacked.

Existing designs have sought to increase the axial compression strength of the corner posts. These designs involve varying the shape and contour of the posts, and providing means for maintaining their shape while supporting a load.

Some existing designs also provide additional protection to a packaged article by creating spacing between the article and its outer packaging, such as a stretch wrap for example. In this fashion, the exterior of the appliance has a reduced risk of damage when the packaging is opened using a box cutter, for example. These types of corner posts generally have an inner wall and an outer wall separated by an air gap. When assembled, the inner wall is in contact with the appliance, and the outer wall is in contact with an outer packaging. The outer packaging is thus distanced from the appliance by the spacing formed by the air gap in the corner posts.

Disadvantageously, this type of corner post can be difficult to transport. The presence of an air gap makes it such that the corner post is voluminous, with up to 80% of its body being empty space. Additionally, these types of posts are not always reusable. Once damaged, the corner post may be unable to support axial and/or radial compression, and the entire post will need to be recycled at a paper mill.

Gaylord containers are another popular packaging means for appliances and other large or bulk article. These are large containers made of double or triple-walled corrugated cardboard, generally sized to fit on a pallet. Disadvantageously, these types of containers cannot be disassembled and are of a fixed size. Additionally, for large items, these containers may need to be combined with corner posts, such as those described above, in order to provide adequate support. This increases the number of components required to assemble the packaging.

SUMMARY

According to an aspect, a corner piece configured to retain an exterior edge protector and space it apart from an external edge of an article is provided. The corner piece has a body including: an inner member having an apex; an outer member having an apex; a connecting member connecting the inner member to the outer member and substantially aligning their respective apexes, the outer member and the inner member being spaced apart from one another; and a securing element provided in the outer member, the securing element having substantially U-shaped retaining walls engageable with the exterior edge protector to retain the exterior edge protector along the outer member.

In an embodiment, the securing element provided in the outer member is a first securing element, and the body further includes a second securing element provided in the inner member, the second securing element including substantially U-shaped retaining walls engageable with an interior edge protector to retain the interior edge protector along the inner member.

In an embodiment, the body further includes first and second retaining cavities defined in a spacing between the outer member and the inner member on opposite sides of the connecting member, for respectively engaging first and second container walls.

In an embodiment, the retaining cavities are substantially rectangular in shape and have a width of at least 5 mm and at most 100 mm.

In an embodiment, the outer member includes outer and inner sidewalls spaced apart from one another, the inner and outer sidewalls together defining the substantially U-shaped retaining walls.

In an embodiment, the outer sidewalls are partial sidewalls extending parallel to the inner sidewalls along a partial length thereof.

In an embodiment, the outer sidewalls extend parallel to the inner sidewalls along a full length thereof, the outer and inner sidewalls together defining an L-shaped cavity for receiving the exterior edge protector.

In an embodiment, the inner and outer sidewalls are spaced apart from one another by at least 2 mm and at most 15 mm.

In an embodiment, the inner and outer members are spaced apart from one another by at least 10 mm.

In an embodiment, the inner and outer members are substantially L-shaped.

In an embodiment, the body is formed from extruded plastic.

According to an aspect, a method for assembling a protective assembly for protecting an external edge of an article during transport is provided. The method includes the steps of: a) providing an elongated edge protector; b) providing at least one corner piece having a body including: an inner member having an apex; an outer member having an apex; a connecting member connecting the inner member to the outer member and substantially aligning their respective apexes, the outer member and the inner member being spaced apart from one another; and a securing element provided in the outer member, the securing element having substantially U-shaped retaining walls; and c) inserting the elongated edge protector into the U-shaped retaining walls of the securing element.

In an embodiment, the elongated edge protector is a first edge protector and the securing element provided in the outer member is a first securing element, and the body of the at least one corner piece further includes a second securing element provided in the inner member, the second securing element having substantially U-shaped retaining walls; the method further including the steps of providing a second elongated edge protector and inserting the second elongated edge protector into the U-shaped retaining walls of the second securing element.

In an embodiment, in step b), the at least one corner piece is a plurality of corner pieces, and step c) includes inserting the elongated edge protector successively into the U-shaped retaining walls of the securing element in each of the plurality of corner pieces.

In an embodiment, the method further includes the step of evenly spacing the plurality of corner pieces along a length of the elongated edge protector.

In an embodiment, the body of the at least one corner piece further includes first and second retaining cavities defined in a spacing between the outer member and the inner member on opposite sides of the connecting member, the method further including the steps of: f) providing first and second container walls; and g) respectively inserting the first and second container walls into the first and second retaining cavities.

In an embodiment, the method further includes repeating steps a) through e) four times to create four protective assemblies, and assembling the four protective assemblies in a substantially rectangular configuration, thereby defining respective corners of a container box, wherein each of the four protective assemblies are connected to first and second adjacent corners of the container box via the first and second container walls, with each of the four protective assemblies sharing the first and second container walls respectively with the first and second adjacent corners of the container box.

In an embodiment, the method further includes the step of placing the assembled protective assembly along an external edge of an article, and wrapping the article and protective assembly in a protective film.

According to an aspect, a kit for assembling a protective assembly for protecting an external edge of an article during transport is provided. The kit includes: at least one elongated edge protector; and at least one corner piece configured to retain the at least one elongated edge protector, the at least one corner piece having a body including: an inner member having an apex; an outer member having an apex; a connecting member connecting the inner member to the outer member and substantially aligning their respective apexes, the outer member and the inner member being spaced apart from one another; and a securing element provided in the outer member, the securing element including substantially U-shaped retaining walls engageable with the at least one elongated edge protector to retain the at least one elongated edge protector along the outer member.

In an embodiment, the kit includes at least two container walls respectively engageable in a first and second retaining cavities defined in a spacing between the outer member and the inner member on opposite sides of the connecting member.

According to an aspect, a corner piece is provided. The corner piece has a body including an L-shaped outer member with substantially perpendicular sidewalls and an L-shaped inner member with substantially perpendicular sidewalls, the inner and outer members being spaced apart from one another and defining cavities between sidewalls of the outer member and the sidewalls of the inner member, the outer member including a first securing element sized to receive a first elongated L-shaped edge protector and secure it along the sidewalls of the outer member, and the inner member including a second securing element sized to receive a second elongated L-shaped edge protector and secure it along the sidewalls of the inner member.

DETAILED DESCRIPTION

In the following description, the same numerical references refer to similar elements. For the sake of simplicity and clarity, namely so as to not unduly burden the figures, certain reference numbers are not included in some figures when the features they represent can be easily inferred from other figures. The embodiments, geometrical configurations, materials mentioned and/or dimensions shown in the figures or described in the present description are preferred embodiments only, given for exemplification purposes only.

Broadly described, and as better exemplified in the accompanying drawings, the present invention relates to a corner piece which can be used to form protective assemblies for packaging. The corner piece includes a body with an outer member and an inner member spaced apart from one another. At least the outer member is provided with a securing element for retaining and/or securing an edge protector (also referred to as edgeboard, cornerboard, angleboard, a corner post or a vertical support). An edge protector is typically made of cardboard, and can serve to protect the edges of an article, while also serving as a support column for making the article's packaging more resistant to vertical compression and thus more suitable for stacking. The spacing between the inner and outer members can be configured for receiving and securing container walls. The corner piece can be used to form several protective assemblies, also referred to as packaging elements.

Figure 1A:
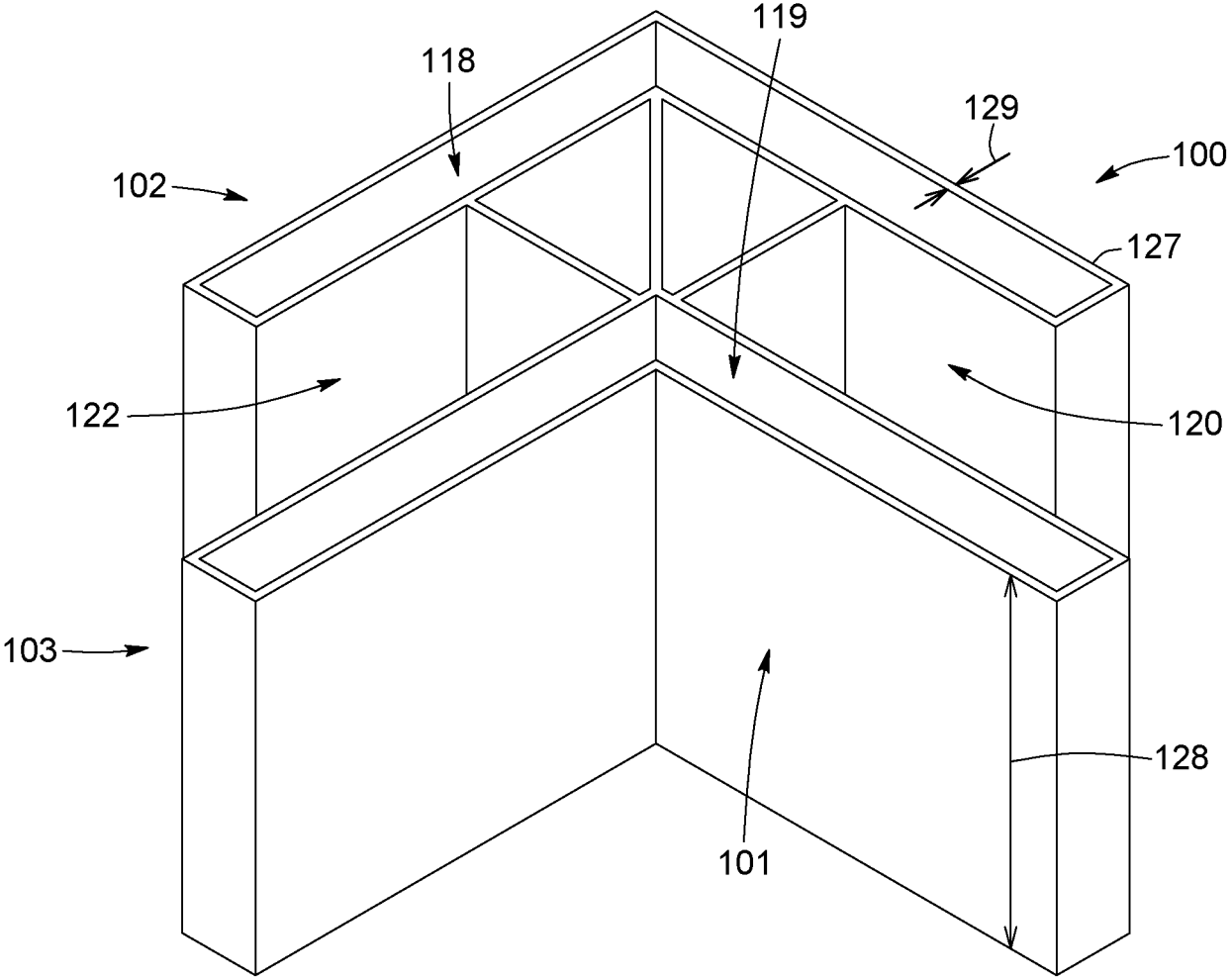
FIG. 1A is a perspective view of a corner piece according to an embodiment.
Figure 1B:
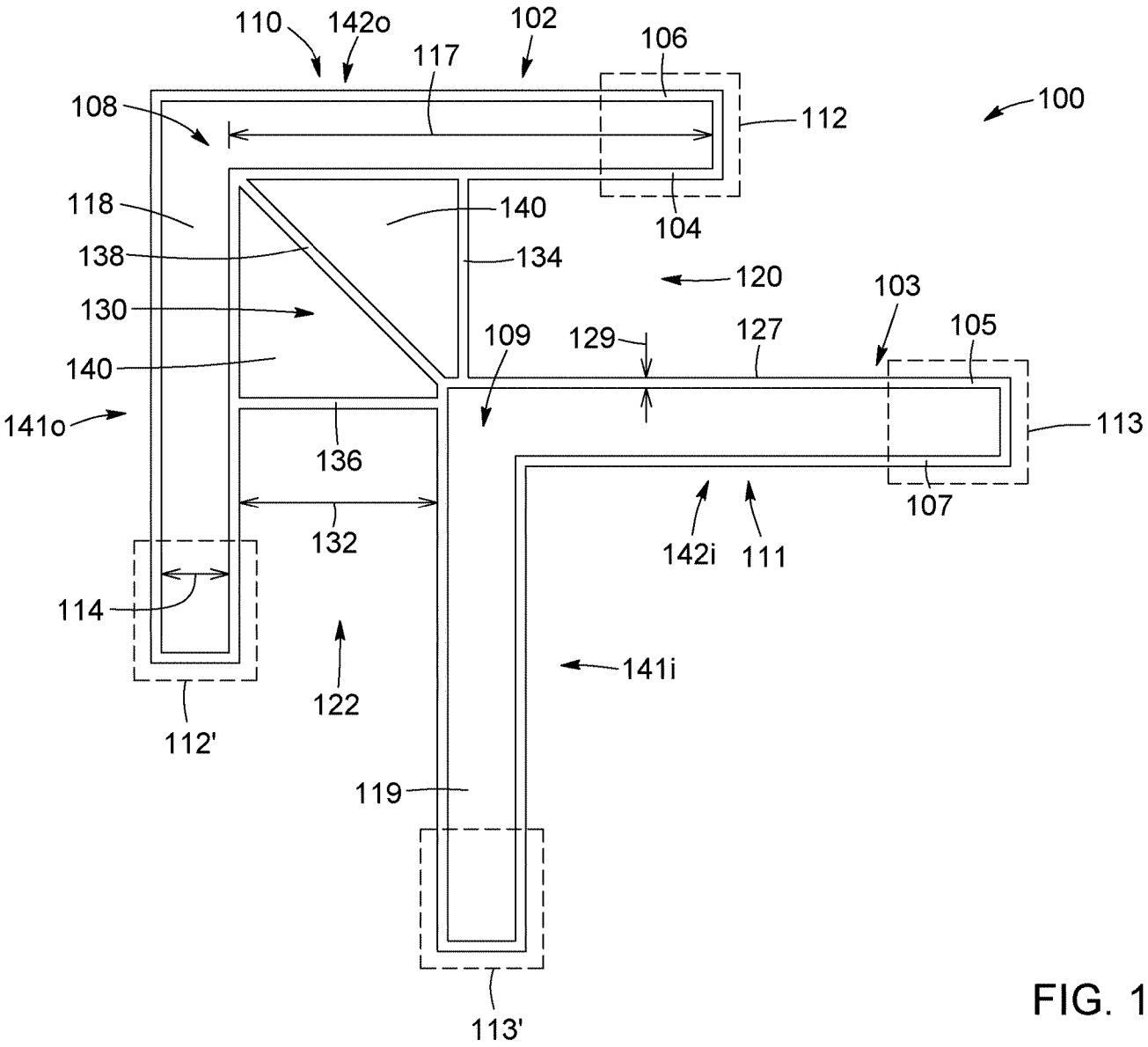
FIG. 1B is a top view of the corner piece of FIG. 1A.

With reference to FIGS. 1A and 1B, a corner piece 100 is shown according to an embodiment. The corner piece 100 has a body 101 which is preferably made from a rigid and recyclable material, such as plastic. The body 101 is preferably elongated, extending along a height 128. Preferably still, a cross section of the body 101 is uniform along its height, allowing the body 101 to be formed from extruded plastic. In such a configuration, the body 101 is formed of an arrangement of walls 127 defining a shape of the body and its corresponding members 102, 103 and 138. The walls 127 have a thickness 129, and are preferably shaped and arranged to provide members 102, 103 and 138 with adequate rigidity, while minimizing the amount of plastic or other recyclable material used to form them. For example, the walls 127 can be arranged so as to define empty spaces 140 where reinforcement is not needed. Moreover, the height 128 of the body 101 and the thickness 129 of the walls 127 can be varied so as to attain the desired structural properties of the corner piece 100 (for example according to the size and/or strength of the edge protectors and container walls which it is designed to retain), while minimizing the amount of material used to form the body 101.

In the illustrated embodiment, the body 101 of the corner piece 100 has an outer member 102 and an inner member 103. Preferably, the outer member 102 and inner member 103 are spaced apart from one another. Preferably still, the inner member 103 is configured for placing proximate to or along an exterior edge of an article, and can be L-shaped to conform to a perpendicular edge of an article. As can be appreciated, in this configuration, the spacing between the inner member 103 and the outer member 102 defines a separation between an exterior edge of an article and the outer member 102 when the corner piece 100 is placed or installed along an edge of an article.

In the present embodiment, each of the outer 102 and inner members 103 are substantially L-shaped, and can therefore be referred to as being "L-shaped members". In alternate embodiments, however, the shape of the outer and inner members 102, 103 can vary, for example to accommodate different shapes of articles. Preferably, the shapes of the outer and inner members 102, 103 are complementary, in that they can be spaced apart by a nominal distance and arranged parallel to one another without intersecting. Preferably still, each of the outer and inner members 102, 103 comprise respective apexes 108, 109, allowing the corner piece to define a corner or angle.

The outer and inner members 102, 103 are secured to one via a securing member 130. In the present embodiment, the securing member 130 spaces outer and inner members 102, 103 apart from one another by a distance 132, while aligning their apexes 108, 109. Preferably, the securing member 130 rigidly secures the outer and inner members 102, 103 so that they do not move relative to one another when subject to a nominal force. However, in alternate embodiments, the securing element 130 can be configured such that it is partially flexible, allowing the securing element 130 to absorb a shock, for example.

In the illustrated embodiment, the securing element 130 includes first and second walls 134, 136, and is reinforced by reinforcing member 138. The first and second walls 134, 136 extend perpendicular to the outer and inner members 102, 103, on opposite sides of their respective apexes 108, 109. The first and second walls 134, 136 are also positioned perpendicular to one another, with the reinforcing member 138 extending diagonally there between. Other configurations of the securing element 130 are also possible. For example, the reinforcing member 138 can have a different shape or could comprise a more complex arrangement, such as a lattice. Preferably, however, securing member 130 is hollow, and may include inner cavities or empty spaces 140.

The outer and inner members 102, 103 respectively comprise inner sidewalls 104, 105. Each of the inner sidewalls 104, 105 can comprise distinct segments which meet at apexes 108, 109. For example, outer member 102 comprises a first segment 1410 and a second segment 142*o* which meet at apex 108. Similarly, inner member 102 comprises a first segment 141*i* and a second segment 142*i* which meet at apex 109. The first segments 141*i*, 1410 extend substantially perpendicular to second segments 142*i*, 142*o*, defining an L-shaped configuration. Each of the segments 141*i*, 141*o*, 142*i*, 142*o* extends along a length 117. Preferably, the length 117 of first and second segments is identical or similar, thereby forming a substantially symmetrical shape of the members 102, 103 when reflected along apexes 108, 109.

In the illustrated embodiment, the inner sidewall 104 of the outer member 102 extends parallel to the inner sidewall 105 of the inner member 103, and the two are spaced apart by a distance 132, defining first and second retaining cavities 120, 122 with width 132. Preferably, the retaining cavities 120, 122 are rectangular-shaped and configured to receive and secure container walls therein.

For example, the retaining cavities 120, 122 preferably have a width of at least 5 mm and at most 100 mm, and preferably between 10 mm and 40 mm, to secure container walls of a corresponding thickness. Preferably still, the retaining cavities 120, 122 extend on opposite sides of the connecting member 130 and are arranged substantially perpendicular relative to one another, allowing container walls to be secured in a substantially perpendicular configuration. In the present embodiment, the retaining cavities 120, 122 are further defined by the first and second sidewalls 134, 136 of the connecting members, providing end-walls against which the container walls abut when inserted into the cavities 120, 122. Although in the present embodiment the cavities 120, 122 are rectangular in shape, other shapes are also possible, for example to more effectively retain container walls. For example, the cavities can be curved or can include textured sidewalls or ribs.

In the illustrated embodiment, both members 102, 103 and their inner sidewalls 104, 105 are the same size and have the same L-shaped configuration. However, in other embodiments, their relative sizes may vary. Additionally, although the members 102 and 103 are L-shaped in the present embodiment, other shapes are also possible without departing from the scope of the invention. Preferably, the shapes of the members 102 and 103 have complementary forms, and can therefore be arc-shaped or W-shaped, for example.

The outer and inner members 102, 103 are each provided with securing elements 110, 111. The securing elements 110, 111 engage with respective edge protectors and secure the edge protectors along the outer and inner members 102, 103, and preferably along the height 128 of the body 101. As can be appreciated, the securing elements 110, 111 can secure pre-shaped edge protectors, such as laminated cardboard, in a spaced-apart configuration. However, it should also be appreciated that the securing elements 110, 111 can secure a flattened or unshaped cardboard piece while forming it into a particular shape, for example to form the shape of an edge protector. For example, with the securing elements 110, 111 in an L-shaped configuration, a flattened piece of cardboard can be folded in half to form an L-shape. The folded cardboard can then be engaged with securing elements 110, 111, which will retain the cardboard in the folded L-shape. In this sense, the securing elements 110, 111 can also be referred to as shaping elements.

The securing elements 110, 111 in the outer and inner members 102, 103 preferably comprise U-shaped retaining walls 112, 113. The U-shaped retaining walls 112, 113 are configured to retain at least a distal end or wing of a corresponding edge protector. The U-shaped walls 112, 113 each include two parallel segments to fit a wing of the edge protector, and an end segment, facing the tip of the wing. Preferably, each securing element 110, 111 comprises two U-shaped retaining walls, each being for retaining a corresponding wing of an edge protector. For example, in the illustrated embodiment, outer member 102 includes first U-shaped retaining walls 112 for retaining a first wing of an edge protector, and second U-shaped retaining walls 112' for retaining a second wing of an edge protector. Similarly, outer member 103 has respective first 113 and second 113' U-shaped retaining walls.

Although the term U-shaped retaining walls is used, it should be appreciated that other retaining wall shapes and/or different types of retaining elements are also possible, as long as such shapes and/or elements allow to securely retain edge protectors. It should also be appreciated that the securing elements 110, 111 can be provided with more or fewer U-shaped retaining walls, for example to retain a different portion of an edge protector. For example, in some embodiments, the corner piece can be configured for inserting on opposite ends of an edge protector, and the U-shaped retaining elements can retain the ends of the edge protector.

The outer and inner members 102, 103 are further provided with outer sidewalls 106, 107 extending parallel to the inner sidewalls 104, 105, and spaced apart therefrom by a distance 114. The outer sidewalls 106, 107 define, together with the inner sidewalls 104, 105, the U-shaped retaining walls 112, 113. Preferably, the inner 104, 105 and outer sidewalls 106, 107 are spaced apart from one another by a distance 114 between 2 mm and 15 mm, so as to accommodate and secure an edge protector of a corresponding thickness.

In the present embodiment, the outer sidewalls 104, 105 extend along a full length 117 of the inner sidewalls 106, 107. In this fashion, the inner 104, 105 and outer 106, 107 sidewalls together define outer and inner edge protector retaining cavities 118, 119. Outer and inner edge protector retaining cavities 118, 119 are sized to receive respective edge protectors therein. Preferably, the retaining cavities 118, 119 are complementary in shape to a cross-section of the respective edge protectors. For example, in the illustrated embodiment, the retaining cavities 118, 119 are substantially L-shaped cavities for accommodating corresponding L-shaped edge protectors.

Figure 1C:
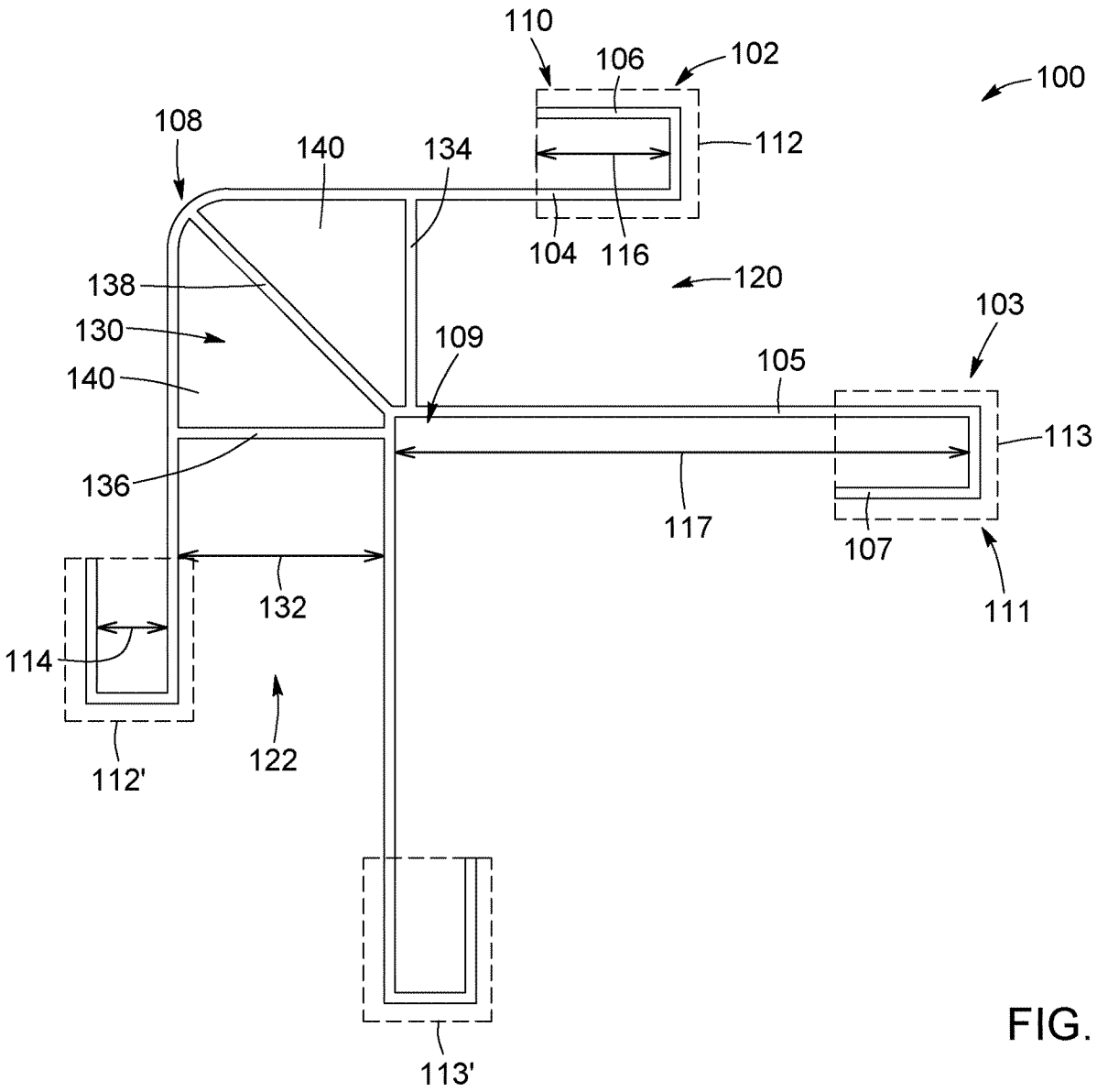
FIG. 1C is a top view of a corner piece according to an alternate embodiment in which the outer sidewalls of the securing elements are partial sidewalls.

It should be understood that in alternate embodiments, different configurations of the securing elements 110, 111 are possible. For example, with reference to FIG. 1C, the outer sidewalls 106, 107 can extend along a partial length 116 of the inner sidewalls 104, 105. In this sense, the outer sidewalls 106, 107 can be referred to as partial sidewalls. In this configuration, the U-shaped retaining walls 112, 113 are still present, however less plastic or other material is required to form the body 101.

Figure 1D:
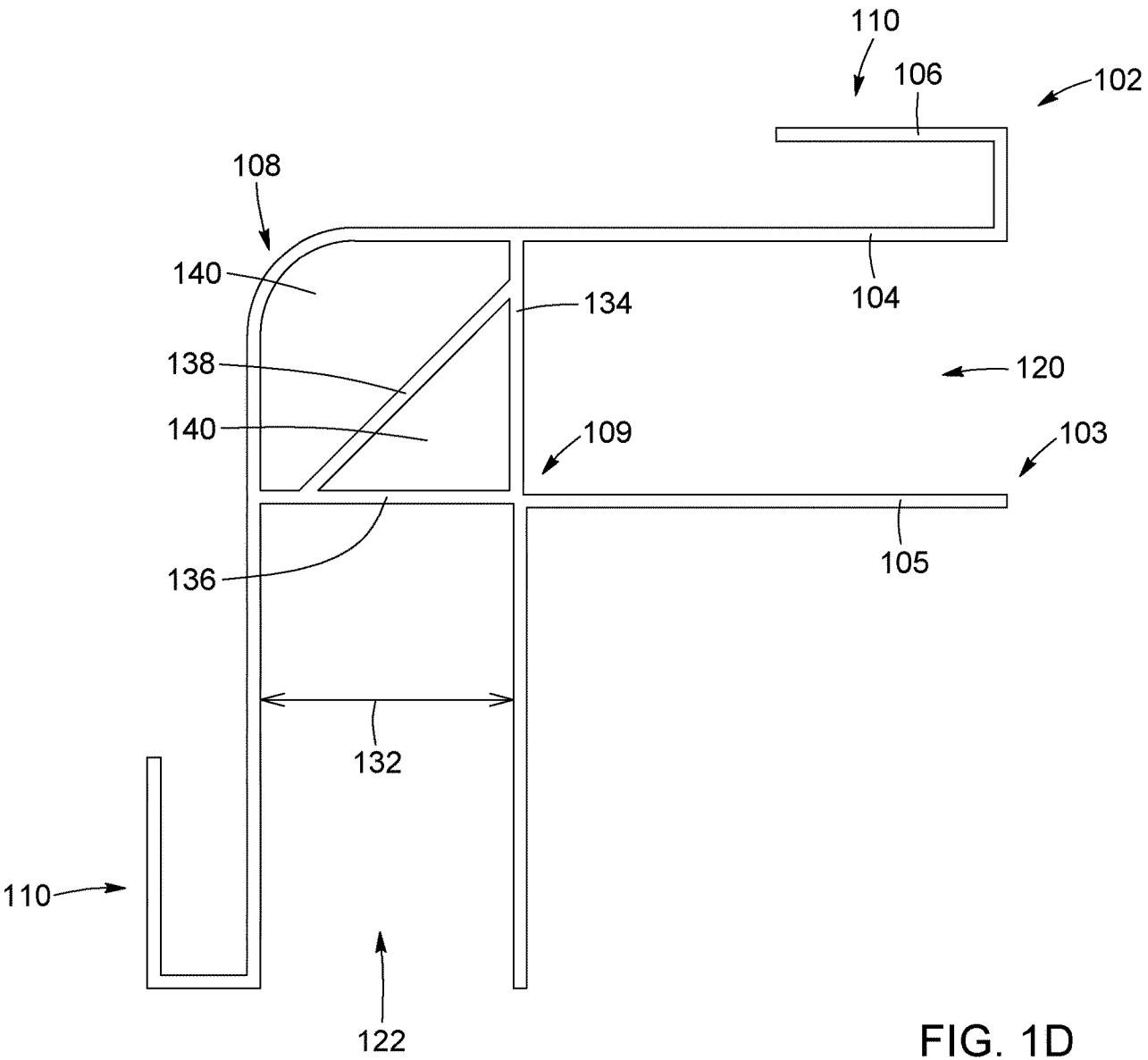
FIG. 1D is a top view of a corner piece according to an alternate embodiment in which a securing element is provided only on the outer member.

As a further example, and with reference to FIG. 1D, in some embodiments, only one securing element is provided. Preferably, and as shown in the illustrated embodiment, a single securing element 110 is provided in the outer member 102. In this fashion, the corner piece 100 can retain an exterior edge protector along the outer member 102 while the inner member 103 is placed adjacent to an edge of an article. The spacing between outer member 102 and inner member 103 will allow for the exterior edge protector to be spaced apart from the edge of the article.

Figure 2A:
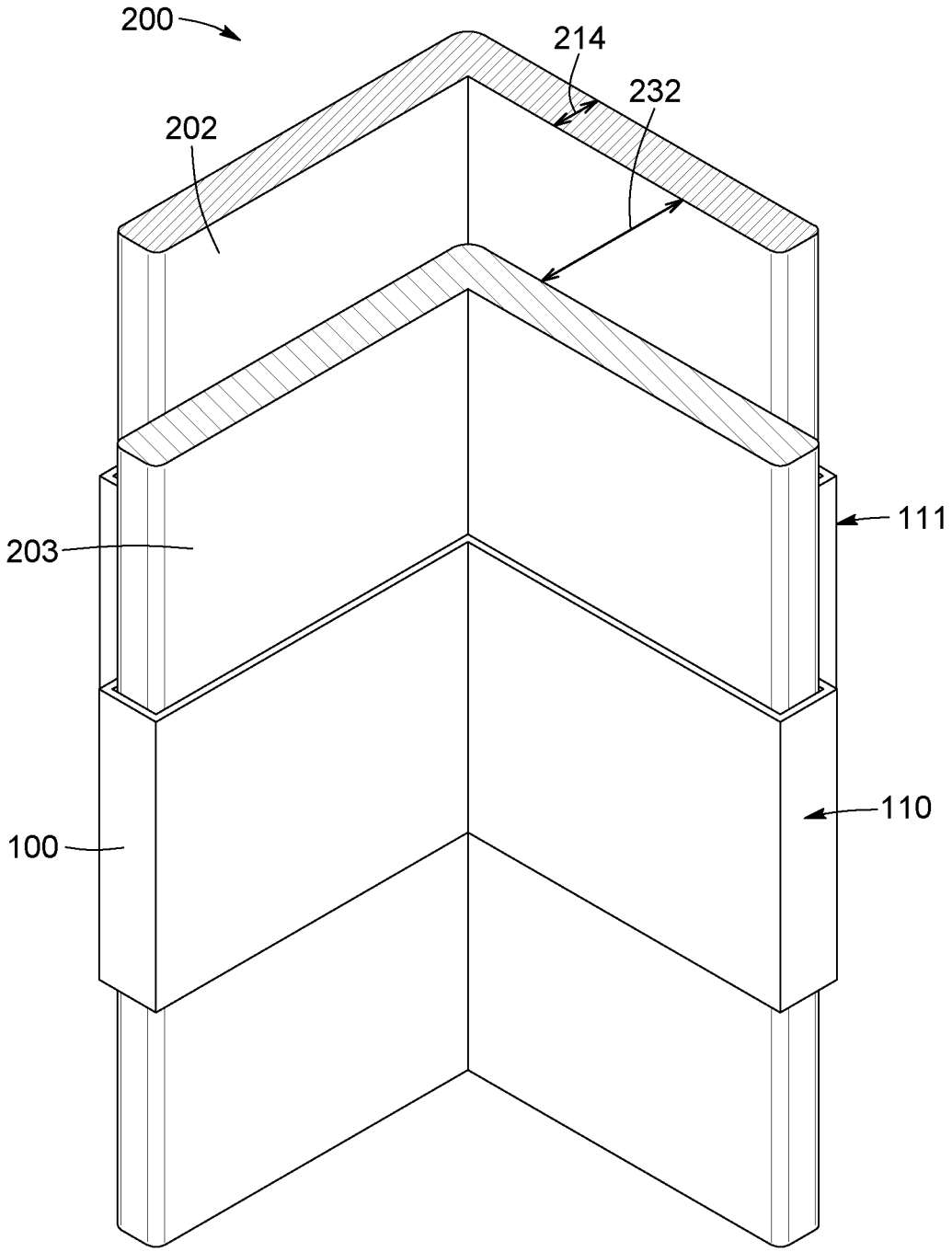
FIG. 2A is a perspective view of a protective assembly according to an embodiment which includes a corner piece engaged with inner and outer edge protectors.
Figure 2B:
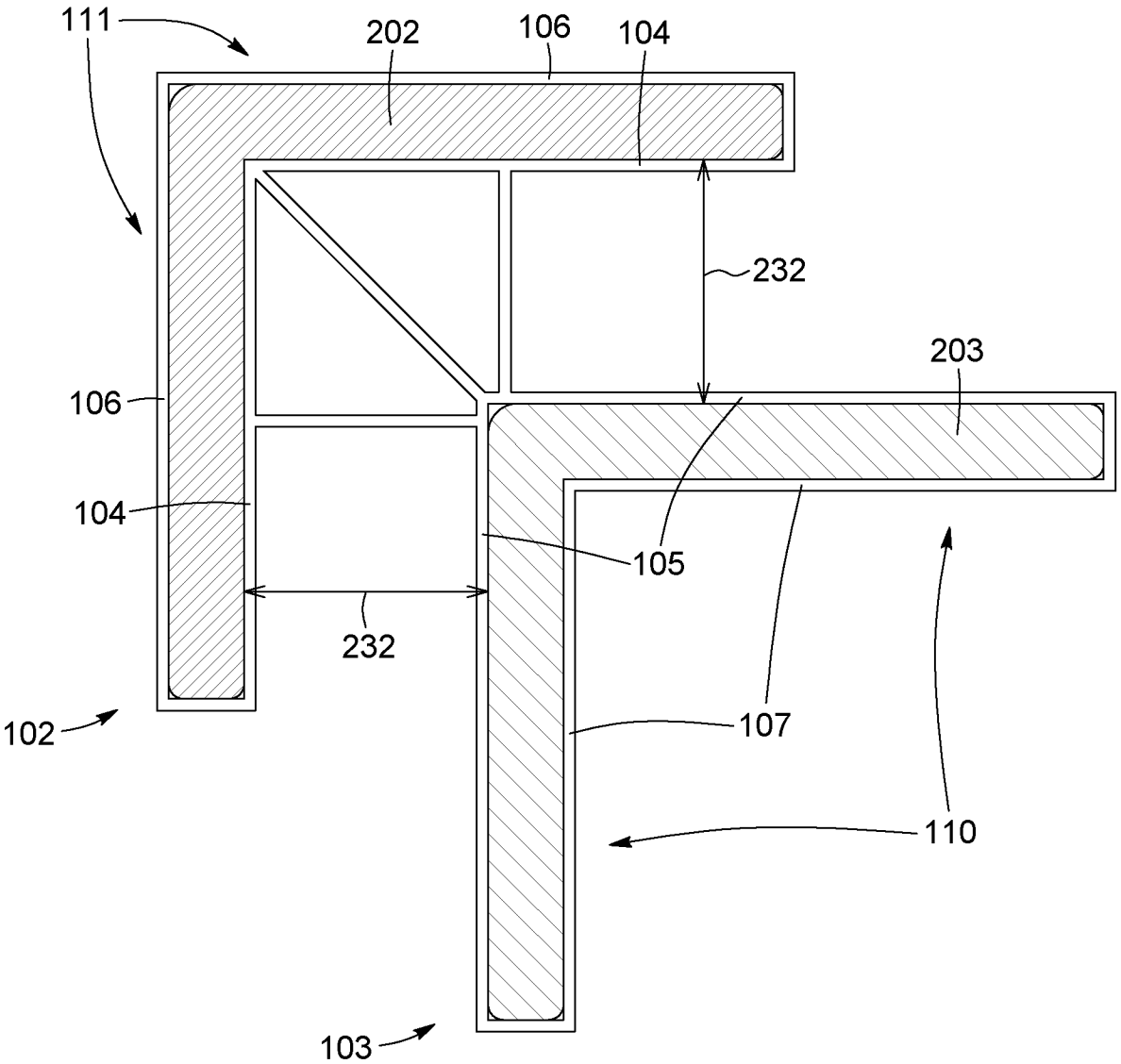
FIG. 2B is a top view of the protective assembly of FIG. 2A.

As can be appreciated, the corner piece 100 can be assembled in several configurations in order to form packaging elements, also referred to as protective assemblies. With reference to FIGS. 2A and 2B, a first protective assembly 200 is shown, the protective assembly being a corner assembly for protecting a corner of an article. In the illustrated corner assembly 200, outer and inner edge protectors 202, 203 are inserted into the first and second securing elements 110, 111 of the outer and inner members 102, 103, respectively. The edge protectors 202, 203 are respectively supported and secured between the inner and outer walls 104, 106 of the outer member 102, and the inner and outer walls 105,107 of the inner member 103.

The edge protectors 202, 203 are preferably straight, rigid, elongated, and preformed into an L-shaped configuration. They can be made of cardboard, for example. In some embodiments, they can be unformed, and be rectangular in shape, while being able to bend around a central seam to form an L-shape. In such embodiments, when the edge protectors 202, 203 are inserted into L-shaped members 102, 103, the edge protectors 202, 203 take the L-shape form of said members. In this configuration, the edge protectors 202, 203 may better resist axial compression, and may be suited for protecting right-angled corners of an article being packaged.

When supported by members 102, 103, the edge protectors 202, 203 are evenly spaced apart along their length by a distance 232, corresponding to the spacing 132 between the outer and inner members 102, 103. In this fashion, if any damage occurs to the outer edge protector 102, the inner edge protector 103 may avoid the damage and protect the packaged article.

Figure 3:
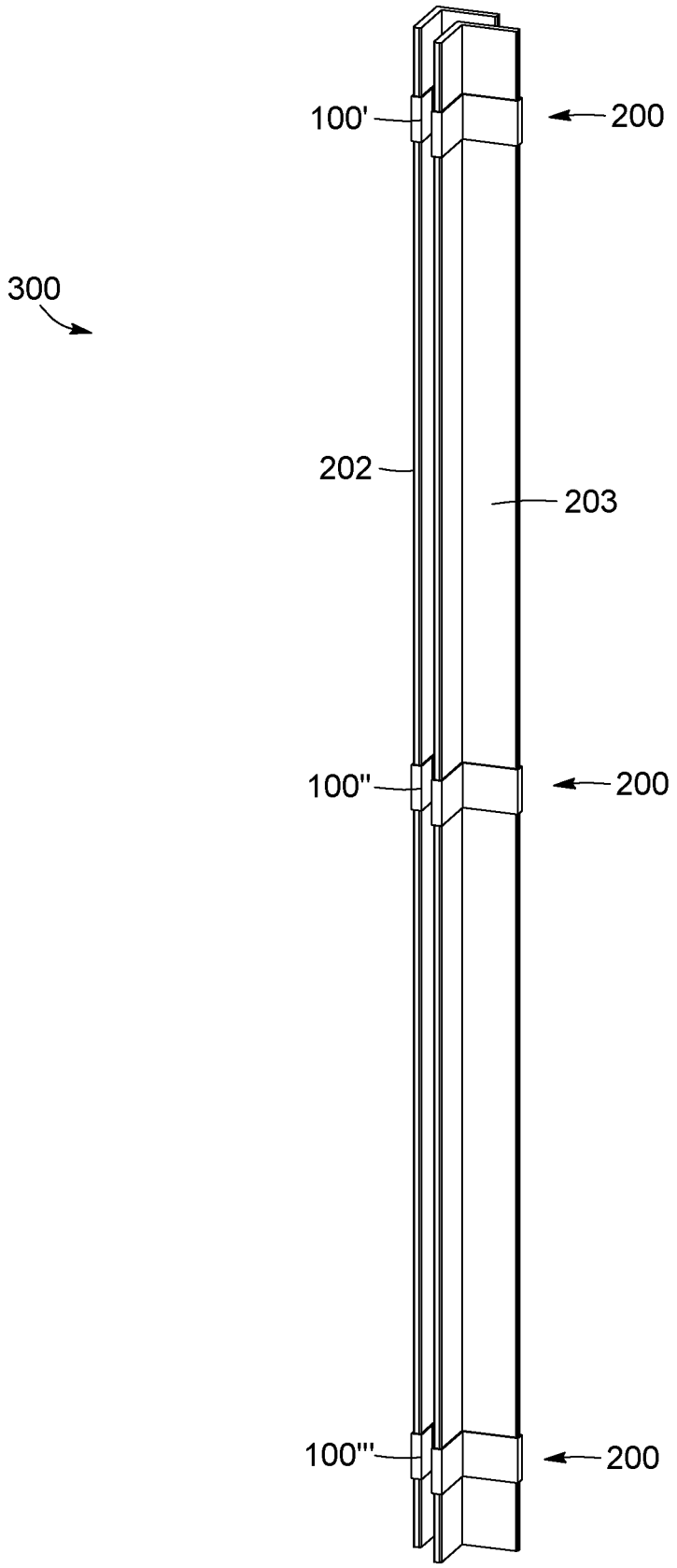
FIG. 3 is a perspective view of a protective assembly according to an alternate embodiment which include a plurality of corner pieces engaged with inner and outer edge protectors.

Several corner pieces 100 can be assembled in a vertical fashion in order to form a protective assembly. In this example, the protective assembly is an L-shaped corner post for packaging, as best shown in FIG. 3. The protective assembly 300 is formed by three corner pieces 100', 100", 100'", each supporting inner and outer edge protectors 202, 203 along their lengths. In the illustrated embodiment, the edge protectors 202, 203 are elongated pieces of cardboard. Of course, in other embodiments, a protective assembly 300 could be formed by using more or fewer corner pieces in combination with longer or shorter edge protectors. In other embodiments, the edge protectors 202, 203 could be made of another material, such as plastic.

As can be appreciated, and referring to FIGS. 1A to 1D, and also to FIG. 3, the protective assembly described above can be assembled with the following steps. First an elongated edge protector or vertical support 202 is provided. Next, at least one corner piece 100 is provided. Then, the edge protector 202 is inserted into the securing element 110 of the outer member 102, preferably in the U-shaped retaining walls 112. The edge protector 202 is thereby secured in the corner piece 100 as an external edge protector which will be spaced apart from a packaged article. In an embodiment a second elongated edge protector 203 can be provided and inserted into the securing element 111 of the inner member 103, preferably in the U-shaped retaining walls 113. In some embodiments, a plurality of corner pieces 100 are provided, and the edge protectors 202, 203 are successively inserted into the securing element in each corner piece 100, the corner pieces 100 thereby being aligned along a length of the edge protectors. Once assembled, the protective assembly 300 can be placed along an external edge of an article, and the article and assembly 300 can be wrapped in a protective film, such as stretch wrap.

Figure 4A:
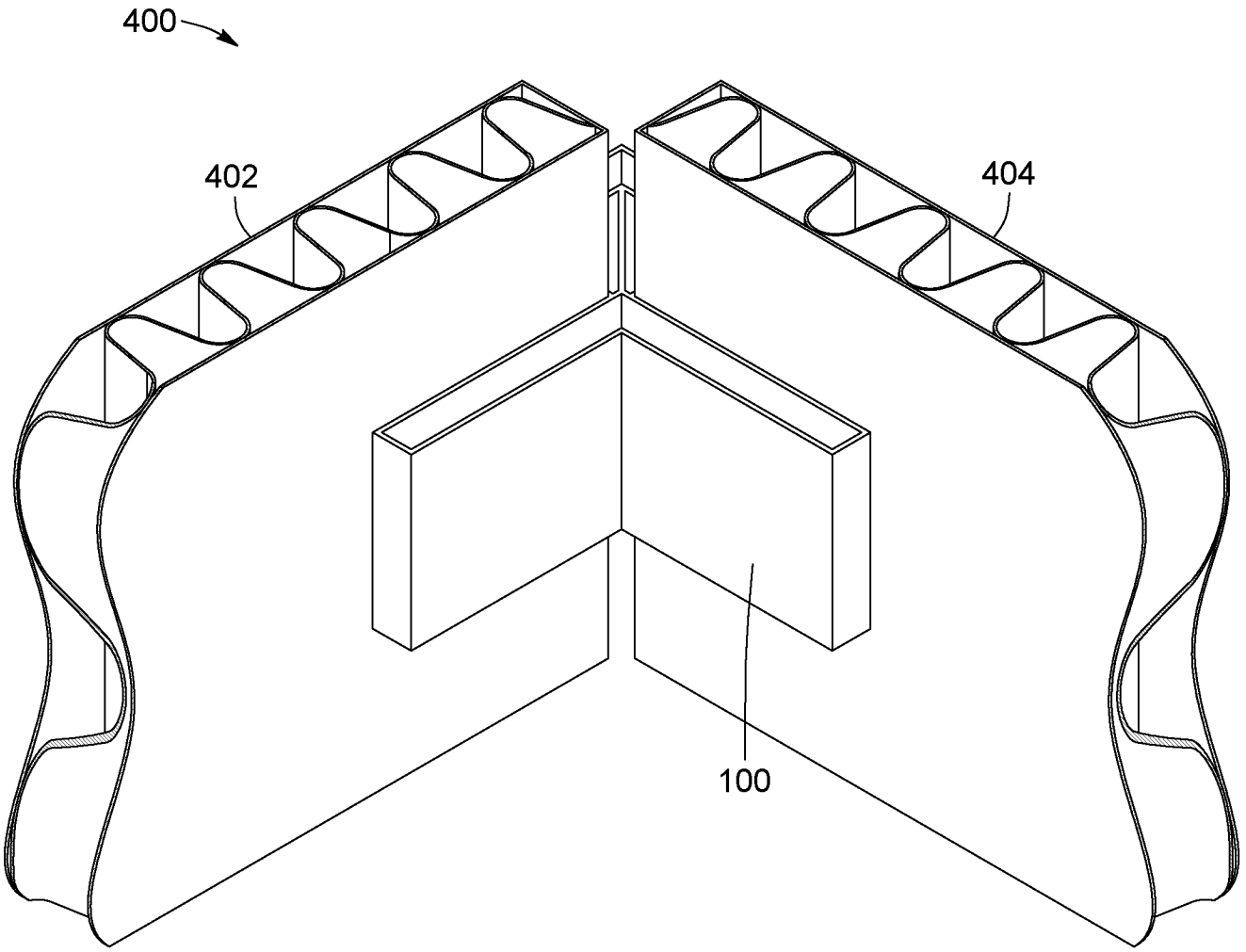
FIG. 4A is a perspective view of a protective assembly according to an alternate embodiment in which a corner piece is engaged with first and second container walls.
Figure 4B:
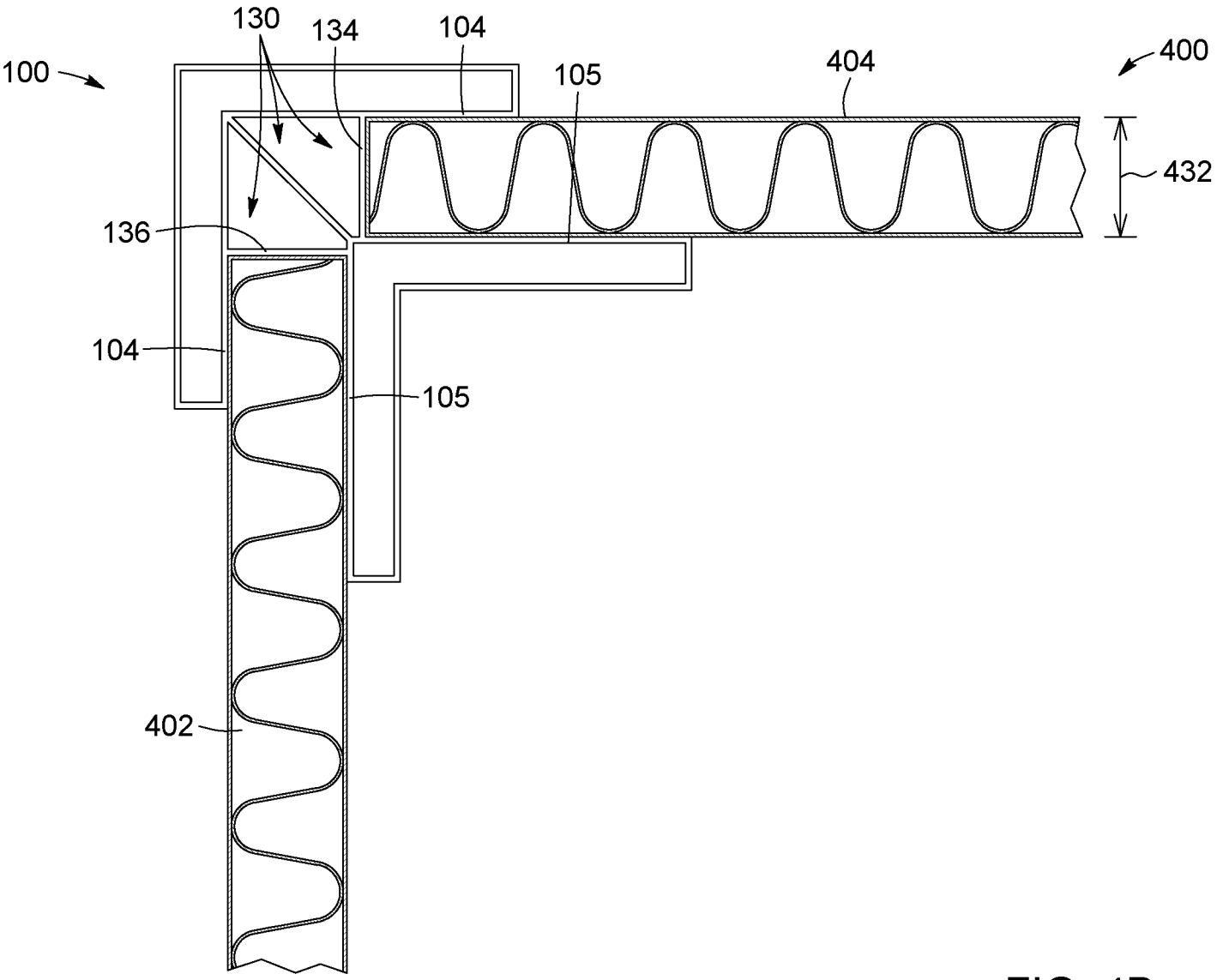
FIG. 4B is a top view of the protective assembly of FIG. 4A.

In other configurations, the corner piece may be used to form a corner of a storage container. With reference to FIGS. 4A and 4B, a second protective assembly 400 is shown, the second protective assembly 400 being a corner of a storage container. In the illustrated assembly 400, the corner piece 100 supports and secures container walls 402, 404 between the inner sidewalls 104, 105 of the outer and inner members 102, 103. The container walls 402, 404 are also abutted against the first and second perpendicular side-walls 134, 136 of the connecting member 130.

In this configuration, the container walls 402, 404 are secured perpendicularly to one another. Of course, in other configurations, for example if the corners of a desired container are not right angles, the corner piece 100 could be shaped such that the walls 402 and 404 are secured at an acute or oblique angle, or secured side-by-side.

In a preferred embodiment, the container walls 402 and 404 are made of a recyclable, rigid material, which is thick enough to fit snugly within the rectangular-shaped retaining cavities 120 and 122. For example, the walls 402 and 404 could be made of double- or triple-walled corrugated cardboard, and have a thickness of between 5 mm and 100 mm.

As can be appreciated, the protective assembly described above can be assembled according to the following steps. First, a corner piece 100 is provided. Next, first and second container walls 402, 404 are provided. Then, the first and second container walls 402, 404 are respectively inserted into the first and second retaining cavities 120, 122.

Figure 5:
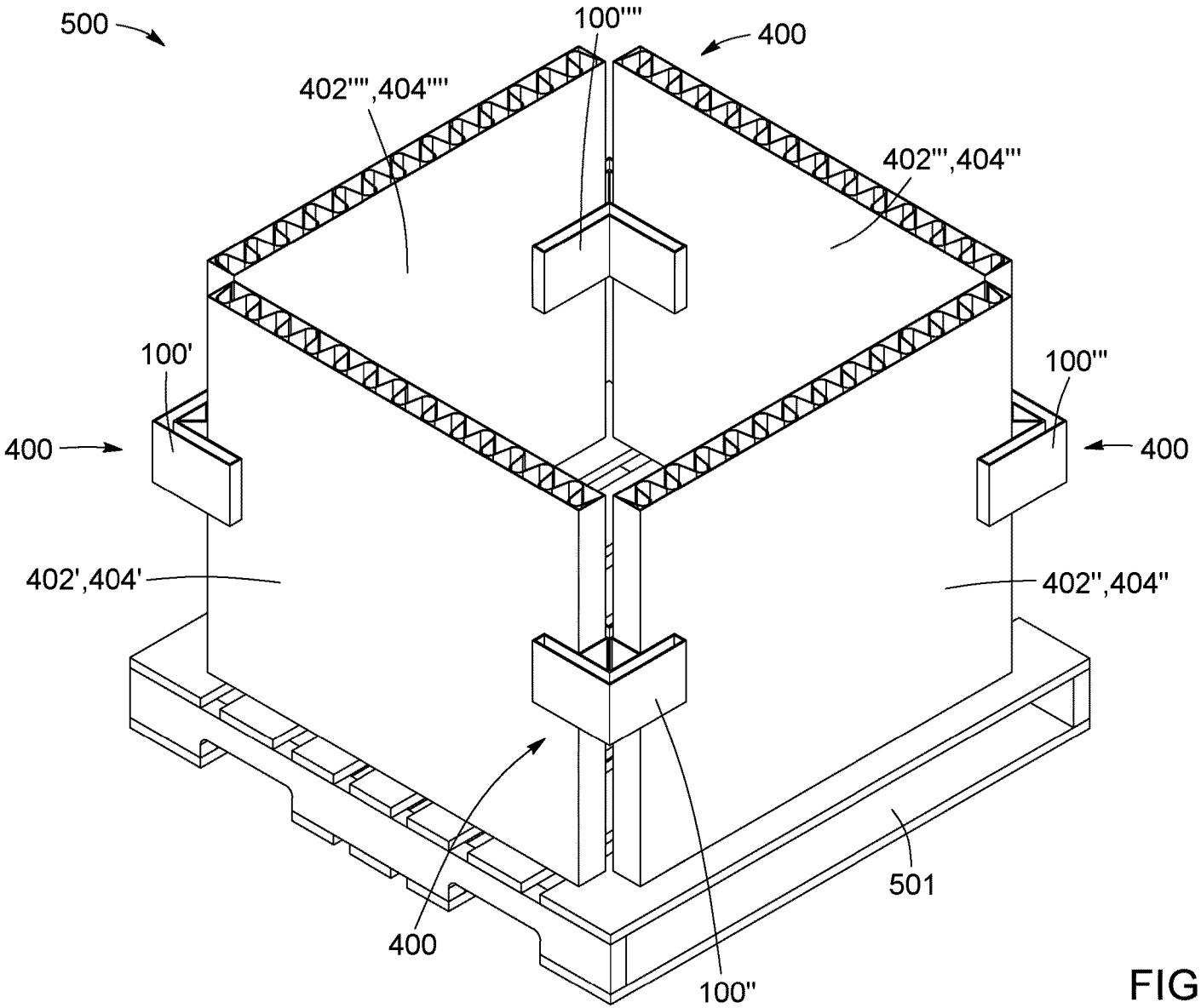
FIG. 5 is a perspective view of a box assembled using the protective assembly of FIG. 4A.

Several storage container corners can be assembled to form a storage container. With reference to FIG. 5, a storage container 500 is formed by four protective assemblies 400, comprising four corner pieces 100', 100", 100'", 100"". Four container walls 402'/404', 402"/402", 402'"/404'", 402""/404"" are thus secured to form a square-shaped box, which may be suitable for stacking on a palette 501. In some embodiments, corner pieces can be provided along the bottom or top side of the box, such that the walls can form a base or lid for the box.

Although in the present embodiment the storage container 500 is square, other configurations are possible. For example, a pair of the walls could be elongated, such that the overall shape of the storage container is rectangular. In other configurations, if the corner pieces retain the walls at an obtuse angle, the corners can be used to assemble a storage container in the shape of an octagon, or other geometric shape.

As can be appreciated, the storage container described above can be assembled according to the following steps. First, four protective assemblies 400 are assembled as described above. Next, the four protective 400 are assembled in a substantially rectangular configuration, forming four corners of the box 500. In this configuration, each of the four protective assemblies 400 are connected to first and second adjacent corners of the container box via the first and second container walls, with each of the four protective assemblies sharing the first and second container walls respectively with the first and second adjacent corners of the container box.

Figure 6A:
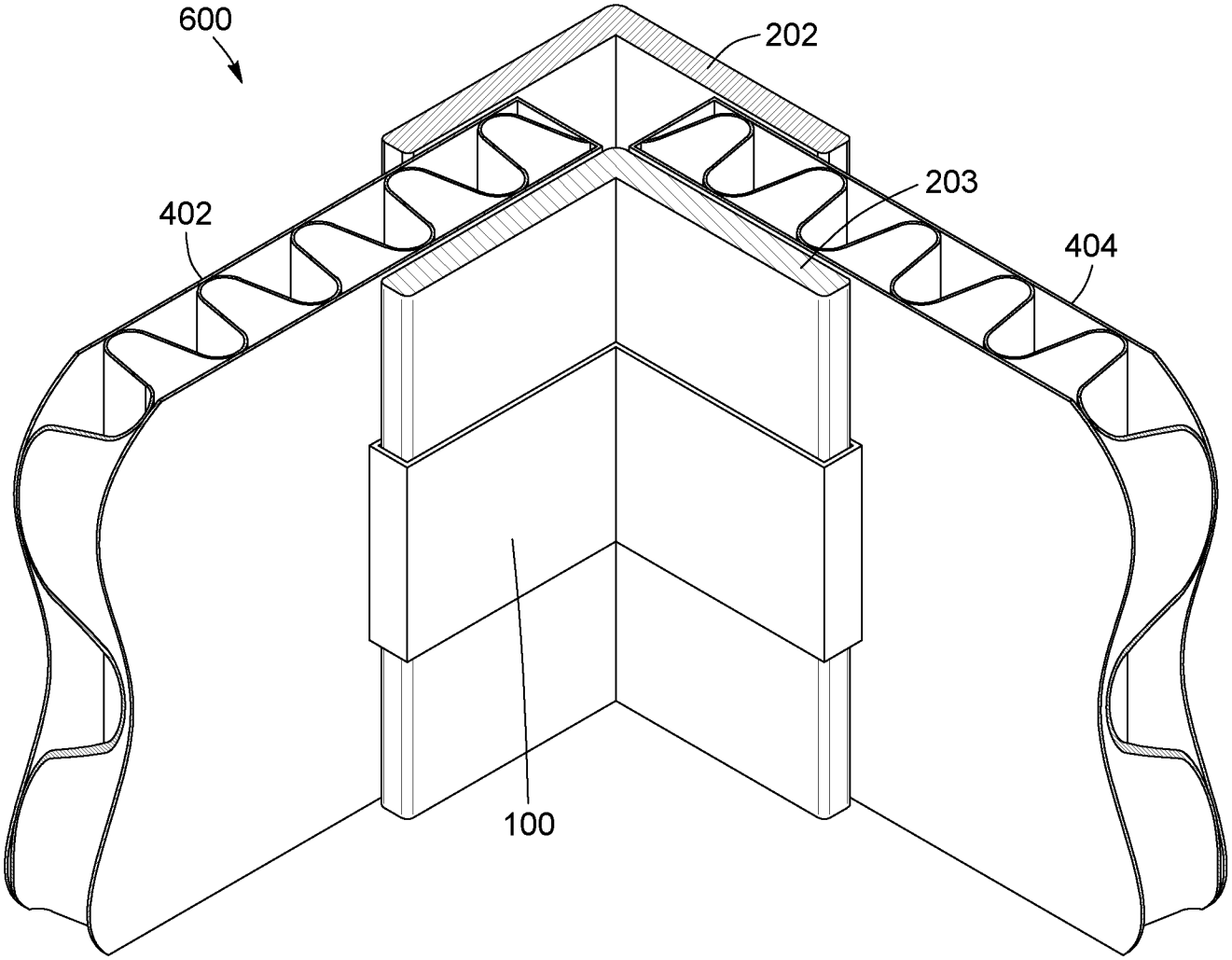
FIG. 6A is a partial perspective view of a protective assembly according to an alternate embodiment which includes a corner piece engaged with inner and outer edge protectors and first and second container walls.
Figure 6B:
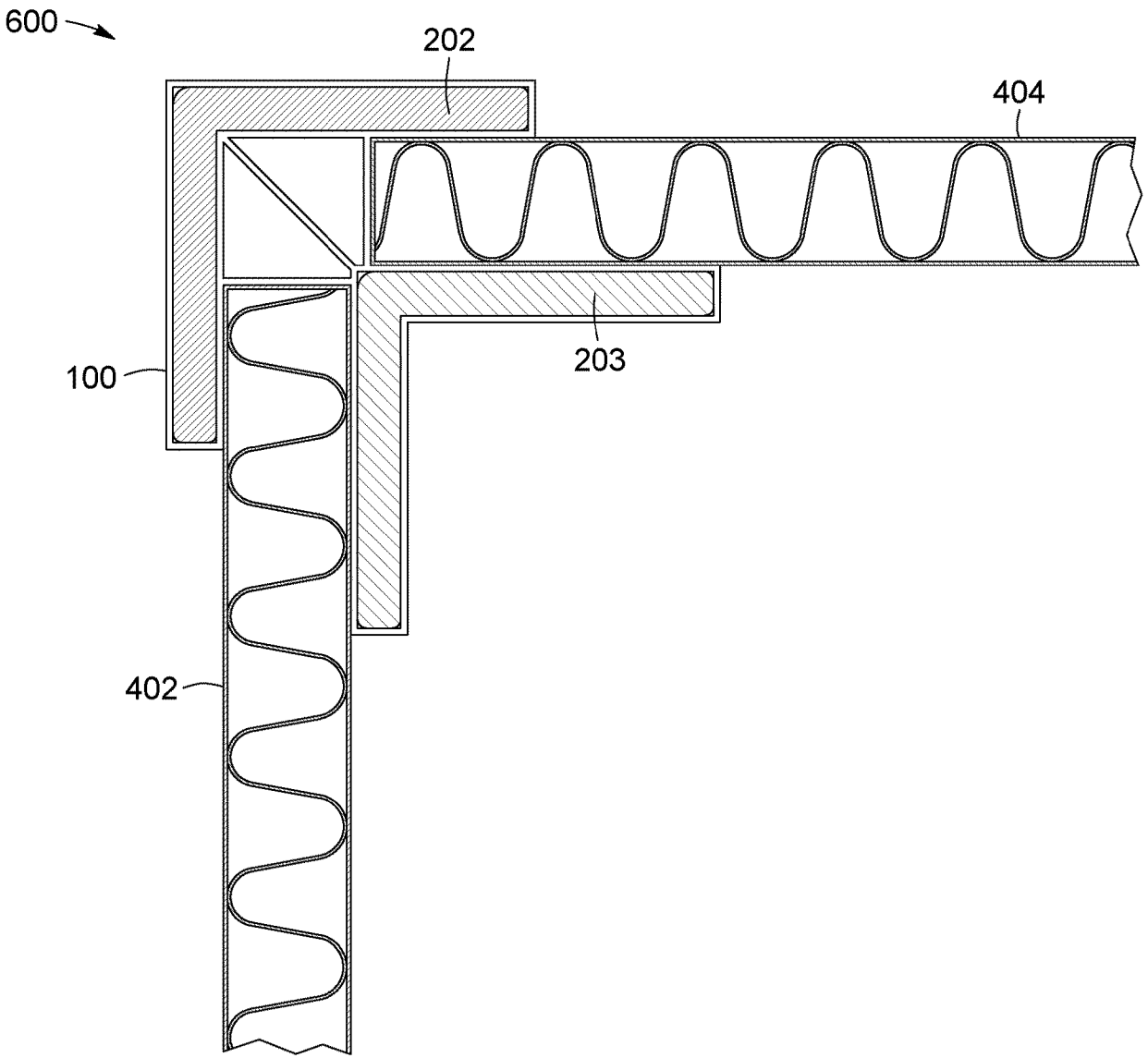
FIG. 6B is a partial top view of the protective assembly of FIG. 6A.

In yet other configurations, the corner piece 100 may be used to form a corner of a storage container with integrated corner posts. With reference to FIGS. 6A and 6B, a third protective assembly 600 is shown. The third protective assembly 600 forms the corner of a storage container with integrated corner posts. The corner piece 100 includes both edge protectors 202, 203 in the L-shaped cavities 110, 111, and container walls 402, 404 in the rectangular-shaped cavities 112, 113. As can be appreciated, third protective assembly 600 can be assembled by combining the steps described above when forming the first 200 and second 400 assemblies.

Figure 7:
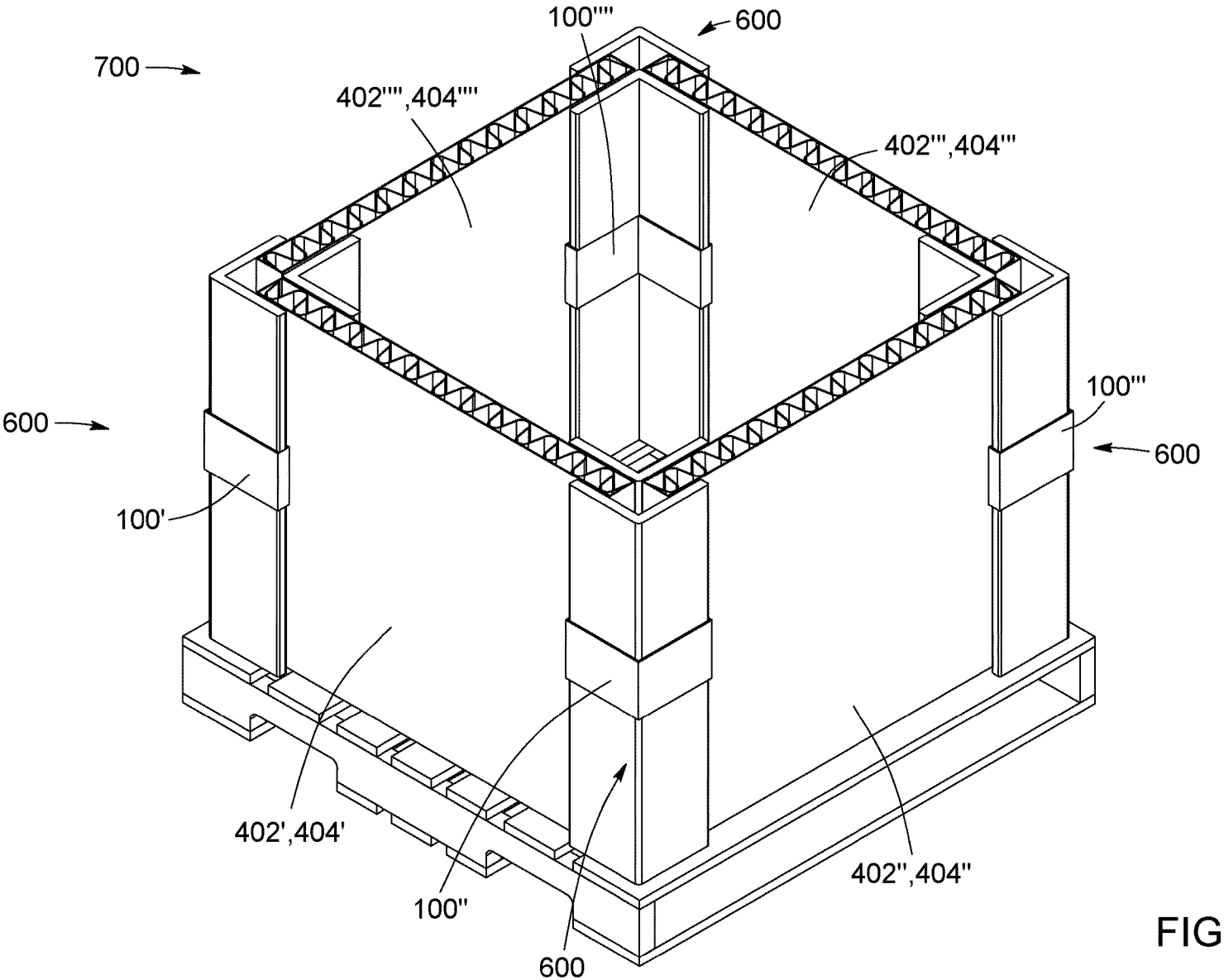
FIG. 7 is a perspective view of a box assembled using the protective assembly of FIG. 6A.

Several storage container corners with integrated corner posts can be assembled to form a storage container with integrated corner posts. With reference to FIG. 7, a storage container with integrated corner posts 700 is formed by assembling four third protective assemblies 600. Four container walls 402'/404', 402"/404", 402'"/404'", 402""/404"" are thus secured between four corner pieces 100', 100", 100'", 100"" to form a square-shaped box, the corners being protected and supported by the inner and outer vertical supports 202, 203. As can be appreciated, the container walls 402'/404', 402"/404", 402'"/404'", 402""/404"" are shared between adjacent protective assemblies 600, meaning that a given container wall can be a first container wall 402' to a first corner assembly, and a second container wall 404' to an adjacent corner assembly. The outer edge protector 202 may further serve to create spacing between the container wall 402 and an outer packaging. For example, if the box is wrapped in plastic, the plastic will be in contact with the outer vertical support instead of the wall. If the plastic is cut, the spacing will avoid damage to the wall 402. As can be appreciated, the storage container with integrated corner posts 700 can be assembled by combining the steps described above when forming the first 200 and second 400 assemblies, and then assembling them into a container 500.

As can be appreciated, the described embodiments provide several advantages. The spacing of the vertical supports better protects the contents of the container. If any damage is done to the outer supports, for example if the container is opened using a box cutter, the inner support can better avoid this damage. The present invention also provides means to reuse packaging materials. If the vertical supports or box walls are damaged, they can simply be removed and replaced. When a box is disassembled, the corner pieces can be reused in other boxes or corner posts, without having to recycle the corner piece back into raw plastic. Finally, the present invention allows for the packaging materials to be transported more easily. When disassembled, the vertical supports do not have empty space, and are more space-efficient during transport. The supports can be assembled at their destination in the form of a corner post, where they will gain increased volume associated with the desired spacing between supports, as described.

The described configurations are but some possible embodiments for the corner piece of the present invention. Although not explicitly mentioned, other useful embodiments or configurations may be apparent to one skilled in the art upon reading the present disclosure. Additionally, although some advantages have been described herein, other advantages may become apparent to one skilled in the art upon reading the present disclosure.

The invention claimed is:

1. A corner piece configured to retain an exterior edge protector and space it apart from an external edge of an article, the corner piece having a body comprising:

an inner member having an apex;

an outer member having an apex;

a connecting member connecting the inner member to the outer member and substantially aligning their respective apexes, the outer member and the inner member being spaced apart from one another, the connecting member being integrally formed with the inner and outer members;

a first securing element provided in the outer member, the first securing element comprising substantially U-shaped retaining walls engageable with the exterior edge protector to retain the exterior edge protector along the outer member, wherein the exterior edge protector is fully retained between the first securing element retaining walls; and a second securing element provided in the inner member, the second securing element comprising substantially U-shaped retaining walls engageable with an interior edge protector to retain the interior edge protector along the inner member, wherein the interior edge protector is fully retained between the second securing element retaining walls.

2. The corner piece according to claim 1, wherein the body further comprises first and second retaining cavities defined in a spacing between the outer member and the inner member on opposite sides of the connecting member, for respectively engaging first and second container walls.

3. The corner piece according to claim 2, wherein the retaining cavities are substantially rectangular in shape and have a width of at least 5 mm and at most 100 mm.

4. The corner piece according to claim 1, wherein the outer member comprises outer and inner sidewalls spaced apart from one another, the inner and outer sidewalls together defining the substantially U-shaped retaining walls.

5. The corner piece according to claim 4, wherein the outer sidewalls are partial sidewalls extending parallel to the inner sidewalls along a partial length thereof.

6. The corner piece according to claim 4, wherein the outer sidewalls extend parallel to the inner sidewalls along a full length thereof, the outer and inner sidewalls together defining an L-shaped cavity for receiving the exterior edge protector.

7. The corner piece according to claim 4, wherein the inner and outer sidewalls are spaced apart from one another by at least 2 mm and at most 15 mm.

8. The corner piece according to claim 1, wherein the inner and outer members are spaced apart from one another by at least 10 mm.

9. The corner piece according to claim 1, wherein the inner and outer members are substantially L-shaped.

10. The corner piece according to claim 1, wherein the body is formed from extruded plastic.

11. A method for assembling a protective assembly for protecting an external edge of an article during transport, the method comprising the steps of:

a) providing first and second elongated edge protectors;

b) providing at least one corner piece having a body comprising:

an inner member having an apex;

an outer member having an apex;

a connecting member connecting the inner member to the outer member and substantially aligning their respective apexes, the outer member and the inner member being spaced apart from one another;

a first securing element provided in the outer member, the first securing element comprising substantially U-shaped retaining walls; and a second securing element provided in the inner member, the second securing element comprising substantially U-shaped retaining walls;

c) inserting the first elongated edge protector into the U-shaped retaining walls of the first securing element, wherein the first elongated edge protector is fully retained between the first securing element retaining walls; and d) inserting the second elongated edge protector into the U-shaped retaining walls of the second securing element, wherein the second elongated edge protector is fully retained between the second securing element retaining walls.

12. The method according to claim 11, wherein in step b), the at least one corner piece is a plurality of corner pieces, and wherein step c) comprises inserting the first elongated edge protector successively into the U-shaped retaining walls of the first securing element in each of the plurality of corner pieces.

13. The method according to claim 12, further comprising the step of evenly spacing the plurality of corner pieces along a length of the first elongated edge protector.

14. The method according to claim 11, wherein the body of the at least one corner piece further comprises first and second retaining cavities defined in a spacing between the outer member and the inner member on opposite sides of the connecting member; the method further comprising the steps of:

e) providing first and second container walls; and f) respectively inserting the first and second container walls into the first and second retaining cavities.

15. The method according to claim 14, further comprising repeating steps a) through f) four times to create four protective assemblies, and assembling the four protective assemblies in a substantially rectangular configuration, thereby defining respective corners of a container box, wherein each of the four protective assemblies are connected to first and second adjacent corners of the container box via the first and second container walls, with each of the four protective assemblies sharing the first and second container walls respectively with the first and second adjacent corners of the container box.

16. The method according to claim 11, further comprising the step of placing the assembled protective assembly along an external edge of an article, and wrapping the article and protective assembly in a protective film.

17. A corner protection assembly for protecting an external edge of an article, the assembly comprising:

an exterior edge protector;

a corner piece configured for retaining the exterior edge protector and spacing the exterior edge protector apart from the external edge of an article, the corner piece having a body comprising:

an inner member having an apex;

an outer member having an apex;

a connecting member connecting the inner member to the outer member and substantially aligning their respective apexes, the outer member and the inner member being spaced apart from one another;

a first securing element provided in the outer member, the first securing element comprising substantially U-shaped retaining walls engageable with the exterior edge protector to retain the exterior edge protector along the outer member, wherein the exterior edge protector is fully retained between the first securing element retaining walls; and a second securing element provided in the inner member, the second securing element comprising substantially U-shaped retaining walls engageable with an interior edge protector to retain the interior edge protector along the inner member, wherein the interior edge protector is fully retained between the second securing element retaining walls.

18. The assembly according to claim 17, wherein the exterior edge protector is L-shaped and includes first and second wings angled relative to each other.

19. The assembly according to claim 18, wherein the U-shaped retaining walls of the outer member include first U-shaped retaining walls for retaining the first wing of the edge protector, and second U-shaped retaining walls for retaining the second wing of the edge protector.

* * * * *